US009551213B2

(12) United States Patent
Frost, Jr.

(10) Patent No.: US 9,551,213 B2
(45) Date of Patent: Jan. 24, 2017

(54) METHOD FOR ESTIMATION OF BULK SHALE VOLUME IN A REAL-TIME LOGGING-WHILE-DRILLING ENVIRONMENT

(75) Inventor: Elton Frost, Jr., Spring, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 597 days.

(21) Appl. No.: 12/754,977

(22) Filed: Apr. 6, 2010

(65) Prior Publication Data

US 2010/0256915 A1 Oct. 7, 2010

Related U.S. Application Data

(60) Provisional application No. 61/167,345, filed on Apr. 7, 2009.

(51) Int. Cl.
*E21B 47/04* (2012.01)
*E21B 49/00* (2006.01)

(52) U.S. Cl.
CPC ..... *E21B 49/00* (2013.01)

(58) Field of Classification Search
CPC ..... E21B 49/00; G01V 11/00; G01N 33/2823
USPC ..... 702/2, 6, 7, 9, 10, 11, 14, 199; 166/366; 73/152.01–152.11, 152.24
See application file for complete search history.

(56) References Cited

U.S. PATENT DOCUMENTS 5,349,528 A 9/1994 Ruhovets
6,052,649 A 4/2000 Goldman et al.
6,968,909 B2 11/2005 Aldred et al.
7,283,910 B2 * 10/2007 Hassan et al. ..... 702/6
2003/0115029 A1 * 6/2003 Calvert et al. ..... 703/10
2007/0061079 A1 * 3/2007 Hu ..... 702/6
2007/0290684 A1 * 12/2007 Edwards ..... 324/312

FOREIGN PATENT DOCUMENTS

GB 2376704 A 12/2002
WO 0123705 A1 4/2001
WO WO2007001759 1/2007

OTHER PUBLICATIONS

Joydip Kanjilal, Dec. 4, 2007, "Working with Nullable Types in C#", http://web.archive.org/web/20071204130951/http://www.devx.com/dotnet/Article/35621/1954?, pp. 1-5.*

(Continued)

*Primary Examiner* — John Breene
*Assistant Examiner* — Yaritza H Perez Bermudez
(74) *Attorney, Agent, or Firm* — Cantor Colburn LLP

(57) ABSTRACT

An apparatus, method and computer-readable medium for estimating a bulk shale volume of an earth formation. In one aspect, measurements are obtained at a plurality of depths in a wellbore penetrating the earth formation and a first distribution is produced of the obtained measurements. A measurement is obtained at a selected depth in the wellbore and a second distribution is produced using the measurement at the selected depth and the measurements obtained at the plurality of depths. A cumulative distribution is produced cumulative of the first distribution and the second distribution. The bulk shale volume is estimated at the selected depth by comparing the cumulative distribution and the second distribution.

22 Claims, 9 Drawing Sheets

(56) References Cited

OTHER PUBLICATIONS

M. M. Herron et al.; "Real-Time Petrophysical Analysis in Siliciclastics From the Integration of Spectroscopy and Triple-Combo Logging," SPE 77631, SPE Annual Technical Conference and Exhibition, San Antonio, Texas, Sep. 29-Oct. 2, 2002, pp. 1-7.
The extended European Search Report; Application No. EP1081933; Date of Mailing: Feb. 28, 2014; pp. 1-9.

* cited by examiner

METHOD FOR ESTIMATION OF BULK SHALE VOLUME IN A REAL-TIME LOGGING-WHILE-DRILLING ENVIRONMENT

CROSS REFERENCE TO RELATED APPLICATIONS

This application claims priority from U.S. Provisional Application Ser. No. 61/167,345, filed Apr. 7, 2009.

BACKGROUND OF THE DISCLOSURE

1. Field of the Disclosure

The present disclosure is related to estimating bulk shale volume in an earth formation during drilling of the formation by processing in situ measurements obtained downhole.

2. Description of the Related Art

In petroleum exploration, various parameters of earth formation are measured to estimate a presence of oil. One useful parameter is bulk shale volume (BSV), which is related to the amount of shale in the earth formation. Bulk shale volume estimates are generally useful for real-time pore pressure prediction, real-time petrophysical analysis and for real-time rock mechanical issues. As a result, real-time processing of measurements related to BSV is desirable.

Various methods are in use for obtaining estimates of bulk shale volume. In wireline testing, for example, a wireline conveys various measurement sensors into a wellbore to obtain measurements related to BSV. In such operations, large amounts of data are typically acquired and later transported to a surface location and downloaded to a surface processor for analysis. Although analysis at the surface processor yields a reasonable estimate of the desired parameter, due to the need to transport the data to the surface for calculations, real-time estimation is not possible. In another method known as Logging-While-Drilling (LWD), sensors are conveyed into the wellbore on a bottomhole assembly (BHA) of a drill string along with a drilling apparatus. Data can be stored in a memory downhole and later dumped to a surface processor for calculations as in wireline testing. In general, however, since data is acquired continuously during the drilling operation, it is desirable to perform relevant calculations downhole.

Several issues concerning estimating bulk shale volume in LWD operations are well-known. Representative measurement values of shale and sand are generally need to obtain an estimate of bulk shale volume. Ideally, both sand and shale would be encountered upon pentration of the formation at the beginning of drilling and would thereby give immediate initial estimates usable in ensuing BSV calculations. However, this is seldom the case. In general, at the start of drilling, the drill string may at first penetrate only shale or only sands, rendering it difficult to obtain an initial estimate of the percentage of bulk shale in the formation. Also, the amount of data obtained typically depends on the amount of the time the sensor is in the wellbore and the rate of penetration of the drill string. Thus, first estimates tend to suffer due to the small amount of data initially available. There is therefore a need for a method of providing a quick estimate of bulk shale volume in real-time during logging while drilling operations.

SUMMARY OF THE DISCLOSURE

The present disclose provides a method, apparatus and compute-readable medium for estimating a bulk shale volume of an earth formation. In one aspect, the method of estimating a bulk shale volume of an earth formation includes: obtaining measurements at a plurality of depths in a wellbore penetrating the earth formation; producing a first distribution of the obtained measurements; obtaining a measurement at a selected depth in the wellbore; producing a second distribution using the measurement at the selected depth and the measurements obtained at the plurality of depths; producing a cumulative distribution cumulative of the first distribution and the second distribution; and estimating the bulk shale volume at the selected depth by comparing the cumulative distribution and the second distribution. The method may include estimating a clean shale response using values selected from a range of high values of the second distribution and the cumulative distribution and estimating a clean sand response using values selected from a range of low values of the second distribution and the cumulative distribution. The method further may include estimating the bulk shale volume using a linear scale derived from the estimated clean shale response and clean sand response. In one aspect, the clean shale response is the maximum of: (a) a maximum value of the second distribution, and (b) an average of (i) a maximum value of the cumulative distribution, and (ii) an average value from a range of high values of the cumulative distribution. In another aspect, the clean sand response is the minimum of: (a) a minimum value of the second distribution, and (b) an average of (i) a minimum value of the cumulative distribution, and (ii) an average value from a range of low values of the cumulative distribution. The cumulative distribution may be seeded at each selected depth, using one of: (i) prior up-hole drilling data, and (ii) data from an offset well. The second distribution may be initialized to null values at each selected depth. In one aspect, the bulk shale volume is estimated at a downhole processor. The selected depth may be one of: i) a depth interval, and ii) a time interval.

In another aspect, the present disclosure provides an apparatus for estimating a bulk shale volume of an earth formation, which includes: a sensor configured to obtain measurements at a plurality of depths of a wellbore penetrating the earth formation; and a processor configured to: produce a first distribution of the obtained measurements; produce a second distribution from a measurement at a selected depth and the measurements at the plurality of depths; produce a cumulative distribution cumulative of the first distribution and the second distribution, and estimate the bulk shale volume at the selected depth by comparing the cumulative distribution and the second distribution. The processor is further configured to estimate a clean shale response using values selected from a range of high values of the second distribution and the cumulative distribution and estimate a clean sand response using values selected from a range of low values of the second distribution and the second distribution. Also, the processor is configured to estimate the bulk shale volume using a linear scale derived from the clean shale response and the clean sand response. In one aspect, the clean shale response is the maximum of: (a) a maximum value of the second distribution, and (b) an average of (i) a maximum value of the cumulative distribution, and (ii) an average value from a range of high values of the cumulative distribution. In another aspect, the clean sand response is the minimum of: (a) a minimum value of the second distribution, and (b) an average of (i) a minimum value of the cumulative distribution, and (ii) an average value from a range of low values of the cumulative distribution. The processor is configured to seed the cumulative distribution at each selected depth using one of: (i) prior up-hole drilling data, and (ii) data from an offset well. The processor is also configured to initialize the first distribution to null values at each selected depth. In one aspect, the processor is configured to estimate the bulk shale volume at a downhole location. The selected depth may be defined using one of: i) a depth interval, and ii) a time interval.

In another aspect, the present disclosure provides a computer-readable medium having instructions stored thereon that when read by a processor execute a method, the method comprising: obtaining measurements at a plurality of depths in a wellbore penetrating the earth formation; producing a first distribution of the obtained measurements; obtaining a measurement at a selected depth in the wellbore; producing a second distribution using the measurement at the selected depth and the measurements obtained at the plurality of depths; producing a cumulative distribution cumulative of the first distribution and the second distribution; and estimating the bulk shale volume at the selected depth by comparing the cumulative distribution and the second distribution. The computer-readable medium may include at least one of: (i) a ROM, (ii) an EPROM, (iii) an EAROM, (iv) a flash memory, and (v) and optical disk.

BRIEF DESCRIPTION OF THE DRAWINGS

For a detailed understanding of the present disclosure, references should be made to the following detailed description of the embodiments, taken in conjunction with the accompanying drawings, in which like elements have generally been given like numerals, wherein.

DETAILED DESCRIPTION OF THE DISCLOSURE

Figure 1:
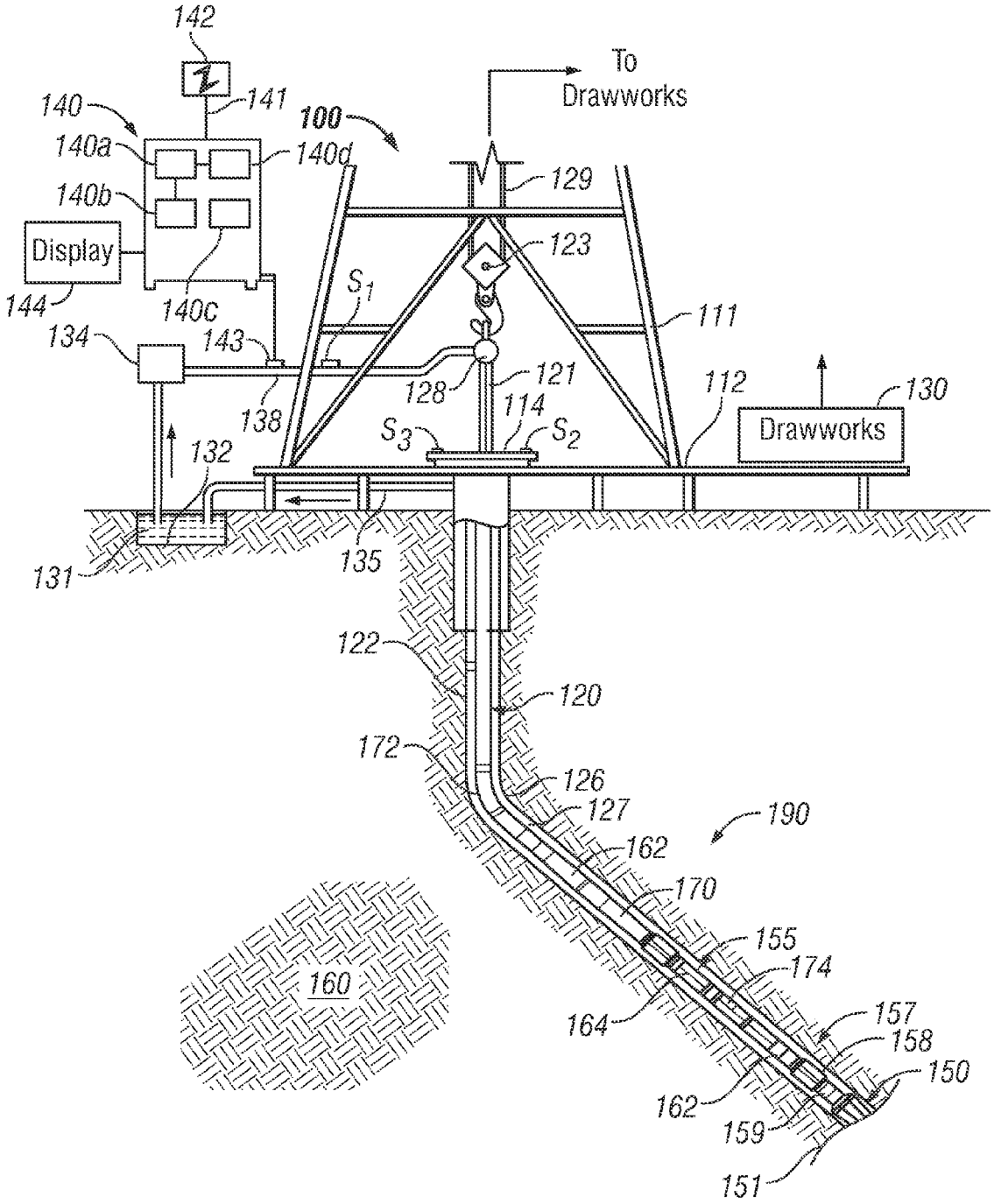
FIG. 1 shows a schematic diagram of a drilling system for drilling a wellbore in an earth formation and for estimating properties or characteristics of interest of the formation surrounding the wellbore during the drilling of the wellbore.

FIG. 1 shows a schematic diagram of a drilling system 100 for drilling a wellbore 126 in an earth formation 160 and for estimating properties or characteristics of interest of the formation surrounding the wellbore 126 during the drilling of the wellbore 126. The drilling system 100 is shown to include a drill string 120 that comprises a drilling assembly (or BHA) 190 attached to a bottom end of a drilling tubular (drill pipe) 122. The drilling system 100 is further shown to include a conventional derrick 111 erected on a floor 112 that supports a rotary table 114 that is rotated by a prime mover, such as an electric motor (not shown), to rotate the drilling tubular 122 at a desired rotational speed. The drilling tubular 122 is typically made up of jointed metallic pipe sections and extends downward from the rotary table 114 into the wellbore 126. A drill bit 150 attached to the end of the BHA 190 disintegrates the geological formations when it is rotated to drill the wellbore 126. The drill string 120 is coupled to a drawworks 130 via a Kelly joint 121, swivel 128 and line 129 through a pulley 123. During the drilling of the wellbore 126 draw works 130 controls the weight on bit (WOB) which affects the rate of penetration.

During the drilling operations, a suitable drilling fluid or mud 131 from a source or mud pit 132 is circulated under pressure through the drill string 120 by a mud pump 134. The drilling fluid 131 passes from the mud pump 134 into the drilling tubular 122 via a desurger 136 and a fluid line 138. The drilling fluid 131 is discharged at the wellbore bottom 151 through an opening in the drill bit 150. The drilling fluid 131 circulates uphole through the annular space 127 between the drill string 120 and the wellbore 126 and returns to the mud pit 132 via return line 135. A sensor $S_1$ in the line 138 provides information about the fluid flow rate. A surface torque sensor $S_2$ and a sensor $S_3$ associated with the drill string 120 respectively provide information about the torque and the rotational speed of the drill string. Additionally, one or more sensors (collectively referred to as $S_4$) associated with line 129 are typically used to provide information about the hook load of the drill string 120 and other desired drilling parameters relating to drilling of the wellbore 126.

The system 100 may further include a surface control unit 140 configured to provide information relating to the drilling operations and for controlling certain desired drilling operations. In one aspect the surface control unit 140 may be a computer-based system that includes one or more processors (such as microprocessors) 140*a*, one or more data storage devices (such as solid state-memory, hard drives, tape drives, etc.) 140*b*, display units 144 and other interface circuitry 140*c*. Computer programs and models 140*d* for use by the processors 140*a* in the control unit 140 are stored in a suitable data storage device 140*b*, including, but not limited to: a solid-state memory, hard disc and tape. The surface control unit 140 also may interact with one or more remote control units 142 via any suitable data communication link 141, such as the Ethernet and the Internet. In one aspect signals from the downhole sensors and devices 143 (described later) are received by the control unit 140 via a communication link, such as fluid, electrical conductors, fiber optic links, wireless links, etc. The surface control unit 140 processes the received data and signals according to programs and models 140*d* provided to the control unit and provides information about drilling parameters such as WOB, rotations per minute (RPM), fluid flow rate, hook load, etc. and formation parameters such as resistivity, acoustic properties, porosity, permeability, etc. The surface control unit 140 records such information. This information, alone or along with information from other sources, may be utilized by the control unit 140 and/or a drilling operator at the surface to control one or more aspects of the drilling system 100, including drilling the wellbore along a desired profile (also referred to as "geosteering").

Still referring to FIG. 1, BHA 190, in one aspect, may include a force application device 157 that may contain a plurality of independently-controlled force application members 158, each of which may configured to apply a desired amount of force on the wellbore wall to alter the drilling direction and/or to maintain the drilling of the wellbore 126 along a desired direction. A sensor 159 associated with each respective force application member 158 provides signals relating to the force applied by its associated member. The drilling assembly 190 also may include a variety of sensors, collectively designated herein by numeral 162, located at selected locations in the drilling assembly 190, that provide information about the various drilling assembly operating parameters, including, but not limited to: bending moment, stress, vibration, stick-slip, tilt, inclination and azimuth. Accelerometers, magnetometers and gyroscopic devices, collectively designated by numeral 174, may be utilized for determining inclination, azimuth and tool face position of the drilling assembly operating parameters, using programs and models provided to a downhole processor at the downhole control unit 170. In another aspect, the sensor signals may be partially processed downhole by the downhole control unit 170 and then sent to the surface controller 140 for further processing.

Still referring to FIG. 1, the drilling assembly 190 may further include any desired MWD (or LWD) tools, collectively referred to by numeral 164, for estimating various properties of the formation 160. Such tools may include resistivity tools, acoustic tools, nuclear magnetic resonance (NMR) tools, gamma ray tools, nuclear logging tools, formation testing tools and other desired tools. Each such tool may process signals and data according to programmed instructions and provide information about certain properties of the formation. The downhole control unit 170 may be used to calculate a parameter of interest from measurements obtained from the various LWD tools 164 using the methods described herein.

Still referring to FIG. 1, the drilling assembly 190 further includes a telemetry unit 172 that establishes two-way data communication between the devices in the drilling assembly 190 and a surface device, such as the control unit 140. Any suitable telemetry system may be used for the purpose of this disclosure, including, but not limited to: mud pulse telemetry, acoustic telemetry, electromagnetic telemetry and wired-pipe telemetry. In one aspect, the wired-pipe telemetry may include drill pipes made of jointed tubulars in which electrical conductors or fiber optic cables are run along individual drill pipe sections and wherein communication along pipe sections may be established by any suitable method, including, but not limited to: mechanical couplings, fiber optic couplings, electromagnetic signals, acoustic signals, radio frequency signals, or another wireless communication method. In another aspect, the wired-pipe telemetry may include coiled tubing in which electrical or fiber optic fibers are run along the length of coiled tubing. The drilling systems, apparatus and methods described herein are equally applicable to offshore drilling systems.

In one aspect, the present disclosure provides a method for determining a bulk shale volume of a formation in real-time. Sensor measurements are taken as the BHA traverses a wellbore. A plurality of measurements is obtained at each level, i.e. depths, of the wellbore. A first distribution is created of the measurements obtained at a selected level. An exemplary first distribution may be a histogram of the measurement values. A second distribution is also created at the selected level. The second distribution is an accumulation of distributions at levels previous to and including the selected level. Bulk shale volume is estimated from the first and second distributions using the methods described herein. In one aspect, a downhole processor may be used to determine the bulk shale volume in real time.

Figure 2:
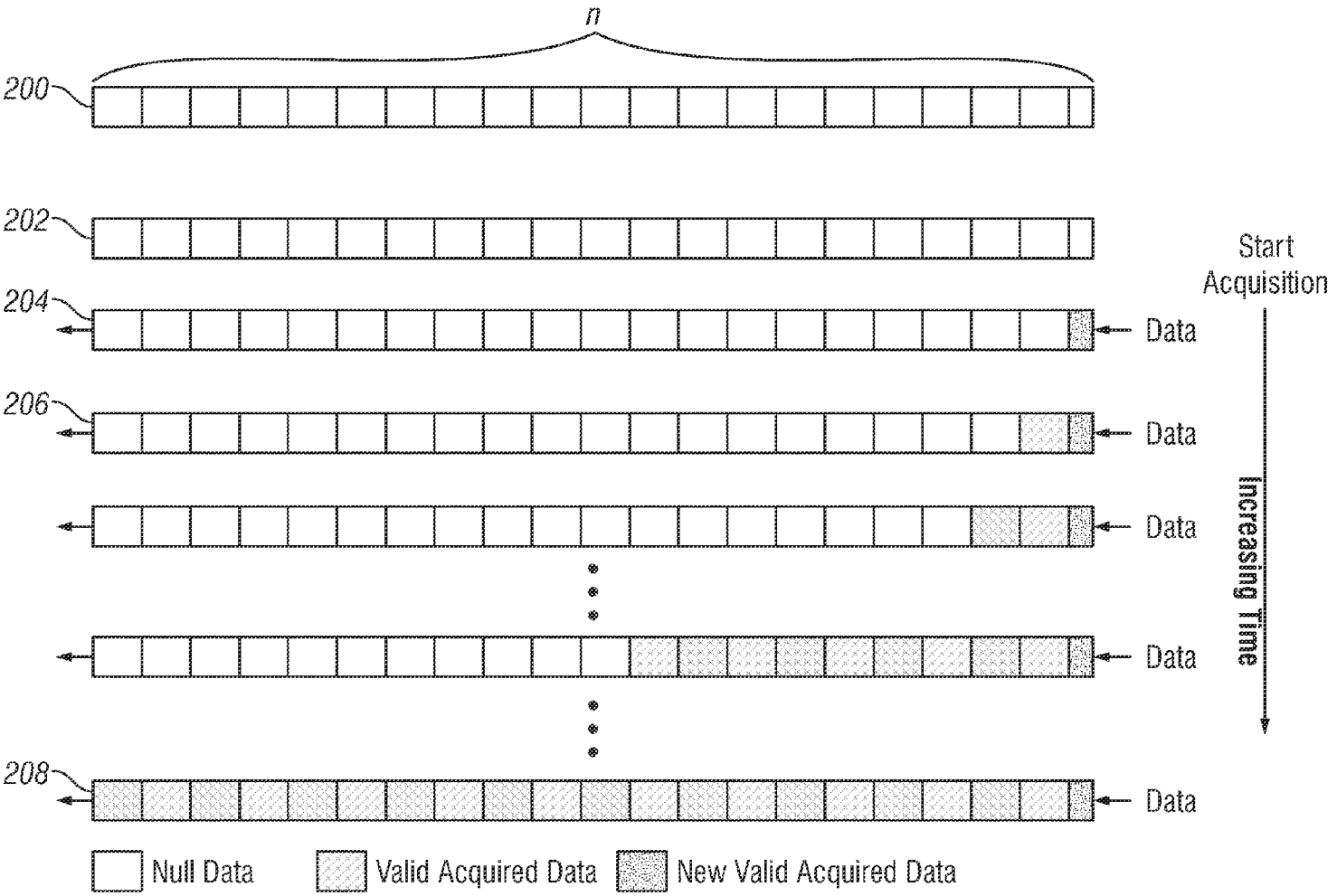
FIG. 2 illustrates a process of acquiring data in an exemplary data buffer in one aspect of the present disclosure.

FIG. 2 illustrates a process of acquiring data in an exemplary data buffer in one aspect of the present disclosure. Exemplary buffer A 200 comprises n memory slots and is shown at various acquisition levels obtained at various times, represented as 202, 204, 206 and 208. Data that is input into buffer A is acquired from various measurement sensors traversing the wellbore. The process of the disclosure is described with respect to natural gamma ray radiation measurements but may also be applied to measurements from other sensors or sensor arrays. Data acquisition begins at 202 when the sensors begin measuring parameters at one or more levels of the wellbore. In one aspect, a level may correspond to a depth within the wellbore. A level may be selected once the BHA has traveled a selected distance from a previous acquisition level, i.e., ½ foot. Alternatively, a level may be selected after a selected time interval, i.e., 30 seconds, between acquisition levels. Prior to data acquisition, each memory slot of buffer A is initialized to null values. At 204, buffer A receives a first data measurement and stores the first data in the first memory slot. The null values are shifted from their current memory slots into the next higher memory slots. The null value in the last (e) slot is therefore moved out of the buffer. At 206, buffer A acquires a second data measurement. The second data measurement is stored in the first memory slot, and the data from the first memory slot is shifted to the second memory slot. All data from the second memory slot and higher are moved from their current memory slot to the next higher memory slot. The null value in the last memory slot is therefore moved out of the buffer. At 208, the entire buffer A is filled with data. New data are entered into the first memory slot and all measurement data are moved from their current memory slots to the next higher memory slot, with the data in the last memory slot being removed from the buffer. Thus, the new data are located at one end of the buffer and the oldest data are located at the other end. In one aspect, data may be screened prior to being placed in buffer A 200 to ensure that the buffered data are within a range of normal validity. Data points outside the valid range may thereby be excluded from subsequent calculations. Data stored in buffer A is used to create a distribution as described with respect to FIG. 3.

Figure 3:
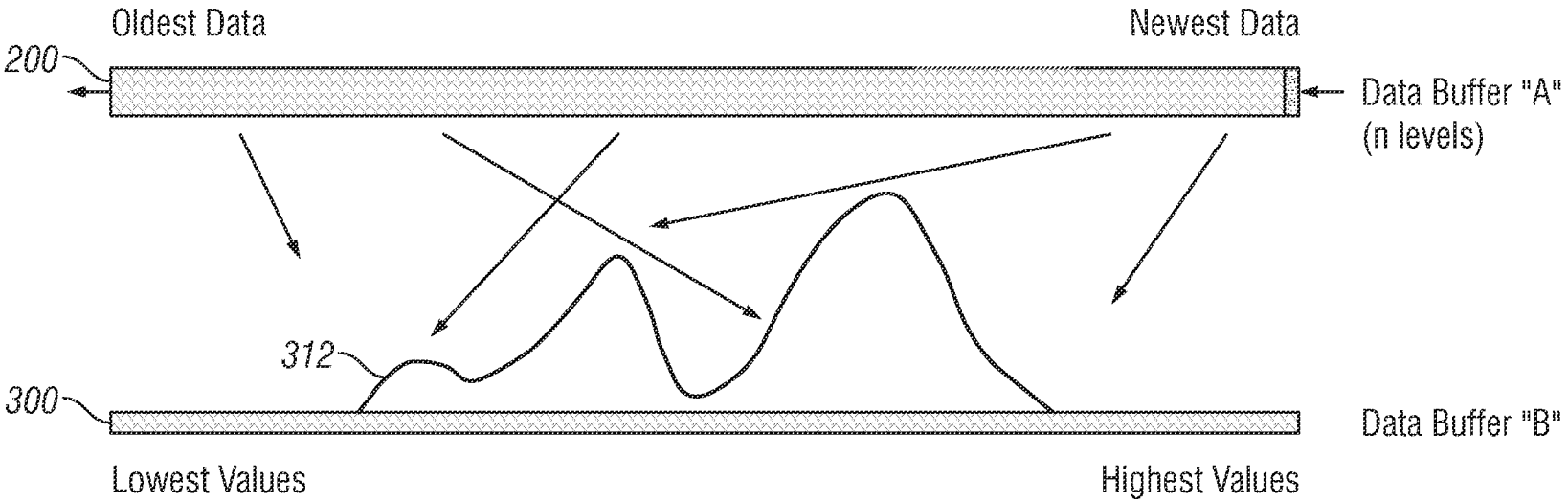
FIG. 3 illustrates a relationship between an acquisition buffer and a distribution buffer.

FIG. 3 illustrates acquisition buffer A and distribution buffer B and the relationship between data in each buffer. Data buffer B 300 stores a distribution 312, wherein the data from buffer A are compressed into buffer B in the form of a distribution. In an exemplary embodiment, the distribution 312 of buffer B may be a histogram, with each memory slot of buffer B representing a value corresponding to a possible value of the data in buffer A. For gamma ray testing, an exemplary histogram may comprise 250 elements with each element representing values in increments of 1 gAPI (American Petroleum Institute units). For instance, memory slot 125 of buffer B may contain a count of the number of acquired data in buffer A that measures 125+/−0.5 gAPI. The memory slots of buffer B 300 are typically initialized to null values at each acquisition level and is then refilled with the latest data from buffer A 200. At each acquisition, memory buffer A obtains a new data point and discards an old data point. Therefore, the distributions formed in memory buffer B at each acquisition level correspond to a different set of data from memory buffer A. A sequence of exemplary distributions obtained at different levels can be seen in distributions 312*a*, 312*b*, 312*c*, . . . , 312*n* of FIG. 4.

Figure 4:
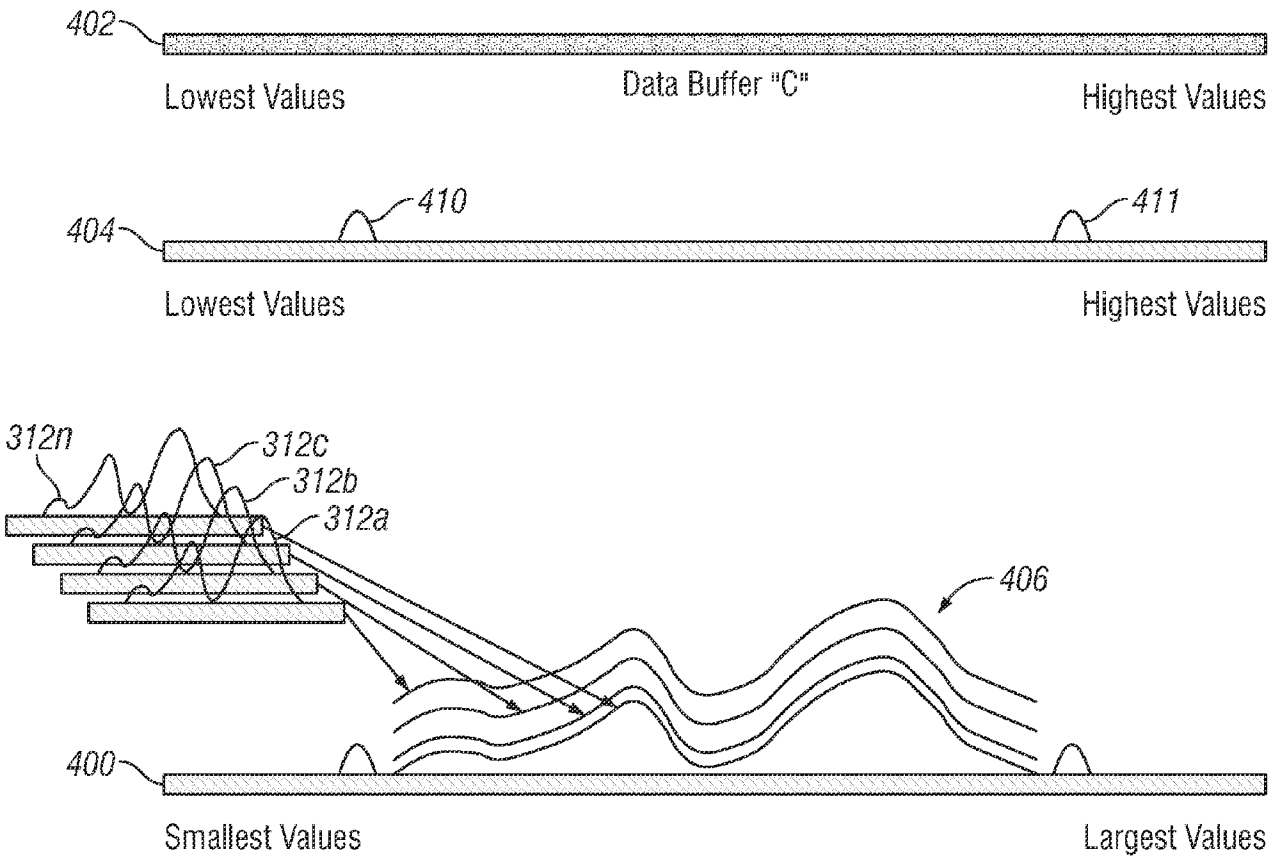
FIG. 4 shows an exemplary data buffer for receiving an accumulation of distributions.

FIG. 4 shows an exemplary cumulative data buffer C 400 for receiving distributions from buffer B. Buffer C accumulates the distribution 312*a* from data at the selected acquisition level and also distributions (312*b*, 312*c*, . . . , 312*n*) obtained at previous acquisition levels to form a cumulative distribution 406. The distribution of buffer C therefore is a cumulative distribution of the distributions from buffer B. As a result, the dimensions of buffer C 400 are similar to the dimensions of buffer B 300. For a BHA traveling down a wellbore, the previous acquisition levels are uphole of the selected level. At the start of the drilling operation 402, the memory slots of buffer C are initialized to contain null values. At each new level 404, buffer C receives seed data. The seed data may be data that is obtained from prior uphole drilling or from offset wells. Seed data is added to buffer C at each level prior to acquiring data from the selected level. In one aspect, the first set of seed data represents a first estimate of low 410 and high 411 acquisition values. Once seeding is complete at a given acquisition level, only acquired data distributions from buffer B are added to buffer C. Initially, the seed data dominates the population of Buffer C but as data is acquired, the distributions from Buffer B representing the acquired data quickly dominates the cumulative distribution.

Figure 5:
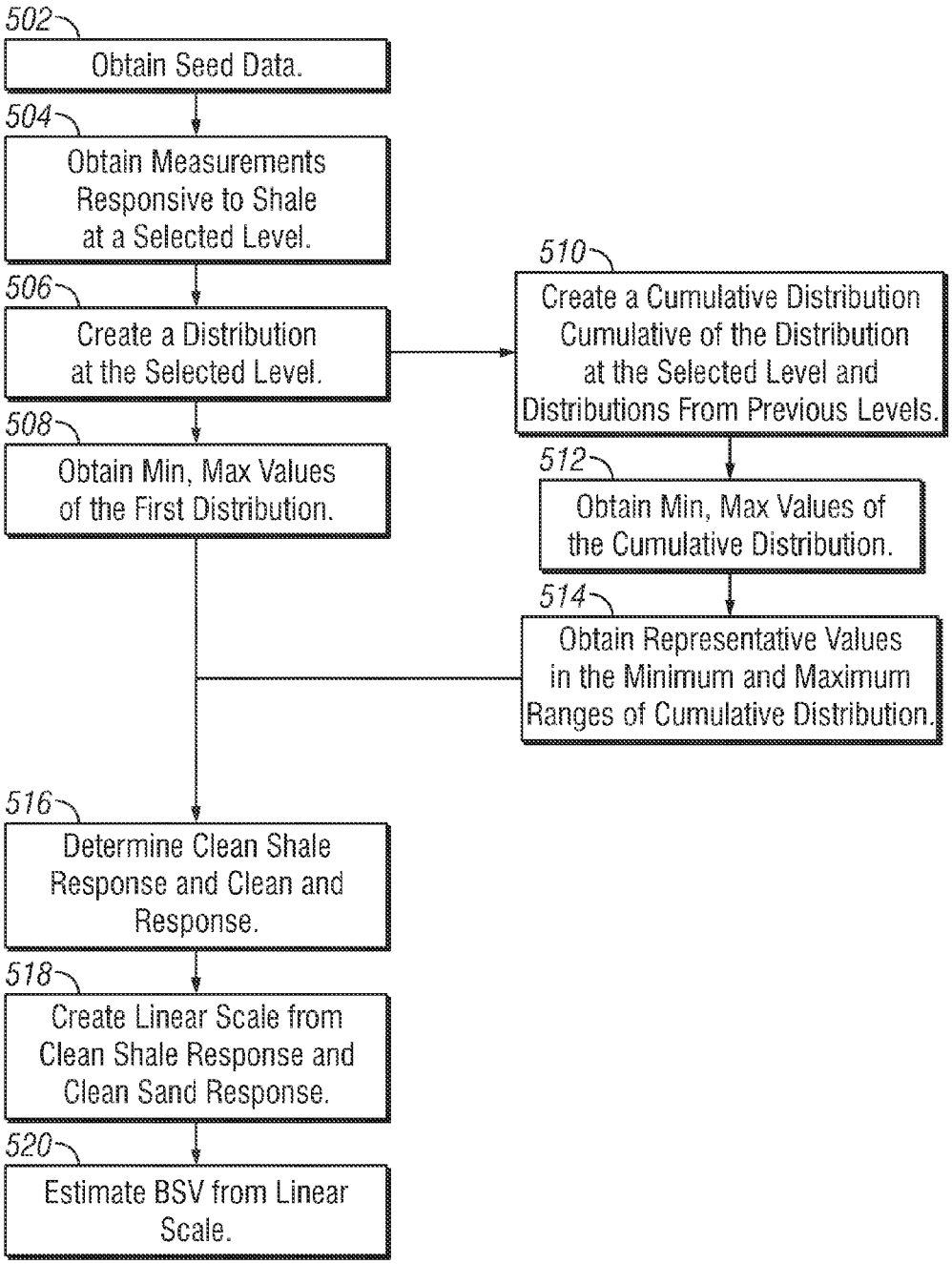
FIG. 5 shows a flowchart of an exemplary method for estimating bulk shale volume in one aspect of the present disclosure.

FIG. 5 shows a flowchart 500 of an exemplary method for estimating bulk shale volume in one aspect of the present disclosure. In Box 502, seed data is obtained. The seed data may be obtained, for example, from prior up-hole drilling of the same well or from offset wells. The seed data provides a representative set of values from clean sand formations and clean shale formations. As an example, an average clean sand may exhibit a measured value of about 20 gAPI units, and an average shale may exhibit a measured value of about 120 gAPI units for a gamma ray measurement that has been properly calibrated and corrected for environment. The method of the present disclosure has a low sensitivity to the initial seed values. Thus, the seed values need only be accurate to within 20%-25% of the expected value.

In Box 504, data measurements related to the presence of shale are obtained at a selected acquisition level in the wellbore. This data is stored in buffer A using the method discussed with respect to FIG. 2. In Box 506, data from buffer A is stored or compressed into buffer B in the form of a distribution. In Box 510, the distribution of buffer B is added to in buffer C in a second (cumulative) distribution. The cumulative distribution created in Box 510, is an accumulation of the distribution created using the methods of Boxes 504 and 506 at the selected level and one or more distributions created using the methods of Boxes 504 and 506 at previous acquisition levels within the wellbore.

In Box 508, a representative minimum value, Min B, and a representative maximum value, Max B, of the first distribution of buffer B at the selected level are estimated. Min B is estimated by querying data that lie at a range of low values of the distribution of buffer B. Max B is estimated by querying data that lie within a range of high values of the distribution of buffer B. Typically, there is more variation in data in the high value range than there is for data at the low value range. The data in the high value range typically represents shale and in one aspect may be weighted based on the increasing values. A query of the high value range may use the upper 5%40% of the data in the high value range. Sands, on the other hand, tend to be represented only a little in the data and their values are typically the minimum of the low value range of values. These can also be statistically weighted so that the lower values have more influence. A query of the low value range may typically use the lower 1%-2% of the data in the low value range.

In Box 512, a representative minimum value, Min C, and a representative maximum value, Max C, of the cumulative distribution of buffer C are obtained using the process outlined for Box 510. In Box 514, averages values are obtained from the low value range ($Min_A$ C) and the high value range ($Max_A$ C) of the cumulative distribution of buffer C. The low value range generally represents measurements responsive to the presence of sand. The high value range generally represents measurements responsive to the presence of shale.

In Box 516, an estimate of a "clean" shale response and an estimate of a "clean" sand response are obtained at the selected level. Once Min B, Max B, Min C, and Max C are obtained, they may be rescaled to account for the normal variation in the formation. Even the cleanest sands typically contain a relatively small amount of shale (i.e., 5%-20% shale). Meanwhile, bulk shales normally have a shale composition of around 95%-100% by bulk shale content. Suitable scaling factors are adopted to fit the geology. The clean sand response is obtained from the Min B, Min C and $Min_A$ C using the following equation:

$$\text{Clean sand response}=\text{Min}(\text{Min}B,\text{Average}(\text{Min}C,\text{Min}_A C)) \quad \text{Eq. (1)}$$

The clean shale response is obtained from Max B, Max C and $Max_A$ C using the following equation:

$$\text{Clean shale response}=\text{Max}(\text{Max}B,\text{Average}(\text{Max}C,\text{Max}_A C)) \quad \text{Eq. (2)}$$

In Box 518 a scale is derived using the obtained clean sand response and clean shale response. The scale may be used to determine a bulk shale volume at the selected acquisition level. In one aspect, the scale is a linear scale based on the clean sand response and the clean shale response obtained in Box 516. An exemplary linear scale may be seen for example in the lines 661, 663, 665, 667, 669 of FIG. 6C, which indicate levels of sand-shale composition derived using the method of the present disclosure. In another aspect, a non-linear scale may be employed based on the geological setting. In Box 520, the bulk shale volume may be estimated using the linear scale.

Figure 6A:
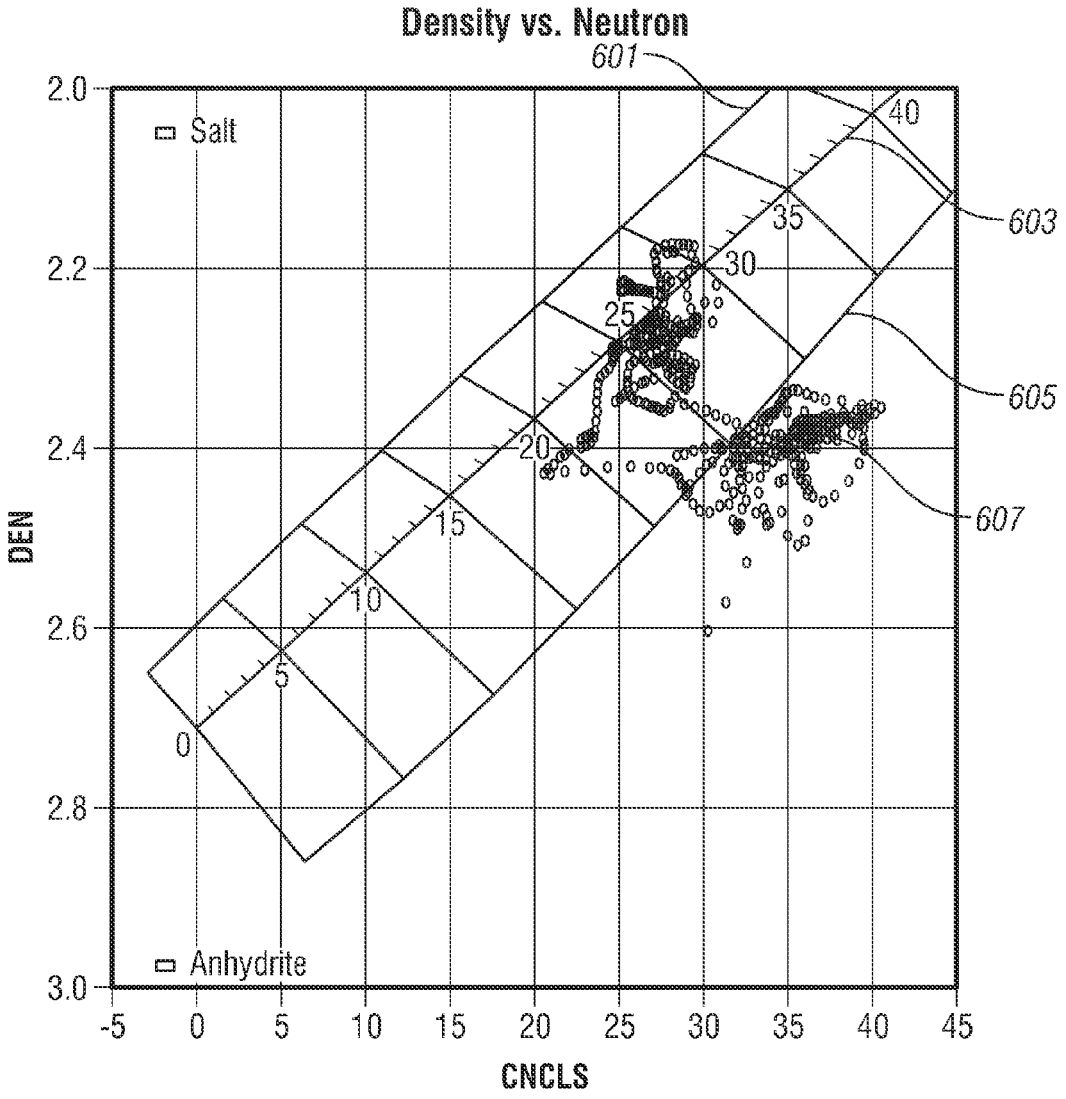
FIG. 6A shows a cross-plot of the density and neutron porosity data.

In an illustrative example of shale identification, FIG. 6A shows a cross-plot of the density (ordinate) and neutron porosity (abscissa) data of gamma rays from various intervals of interest. Lines indicating sandstone 601, limestone 603 and dolomite 605 are shown in the figures. Shales are generally indicated at 607.

Figure 6B:
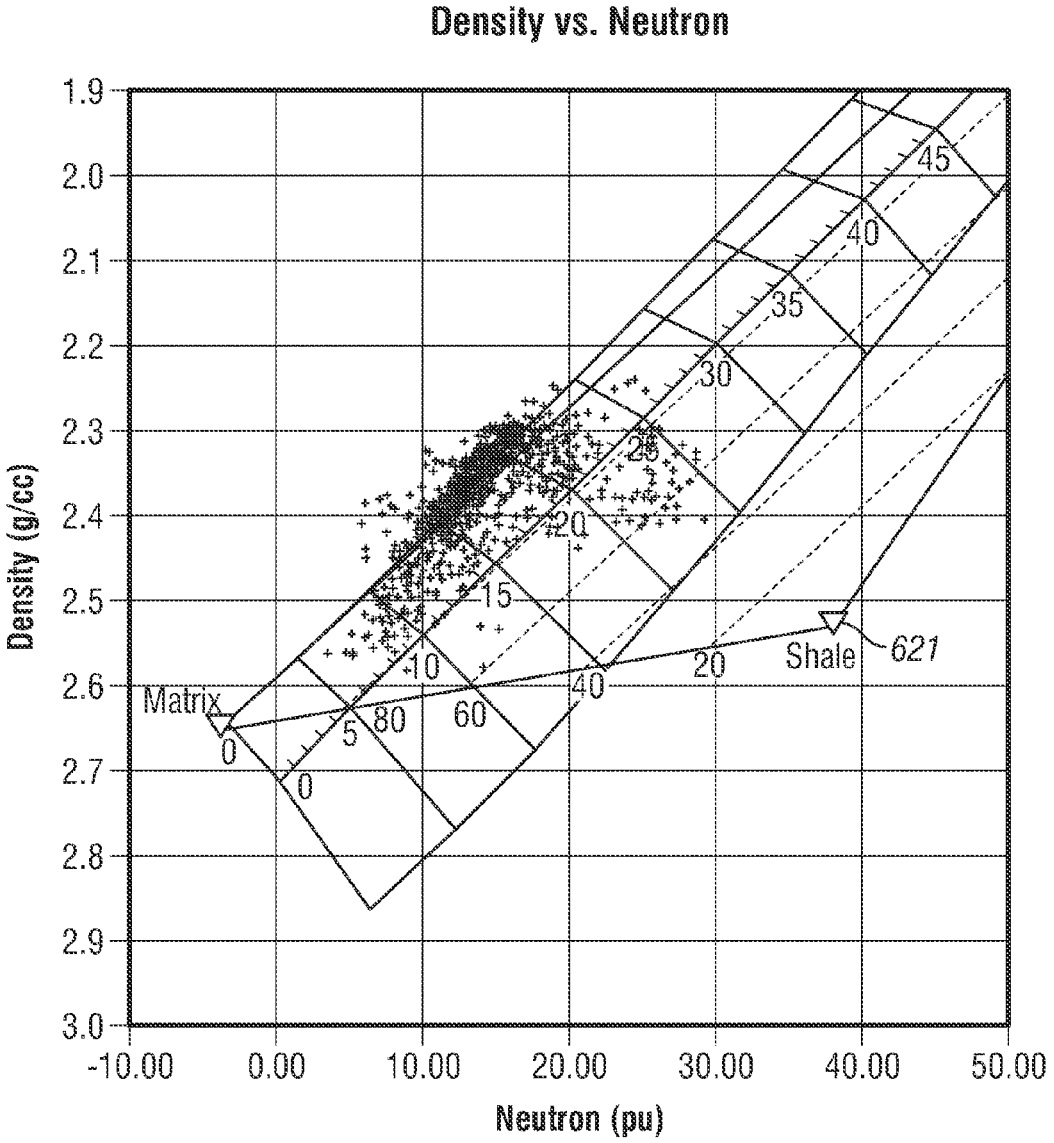
FIG. 6B shows a cross-plot similar to FIG. 6A with gamma ray values superimposed.
Figure 6C:
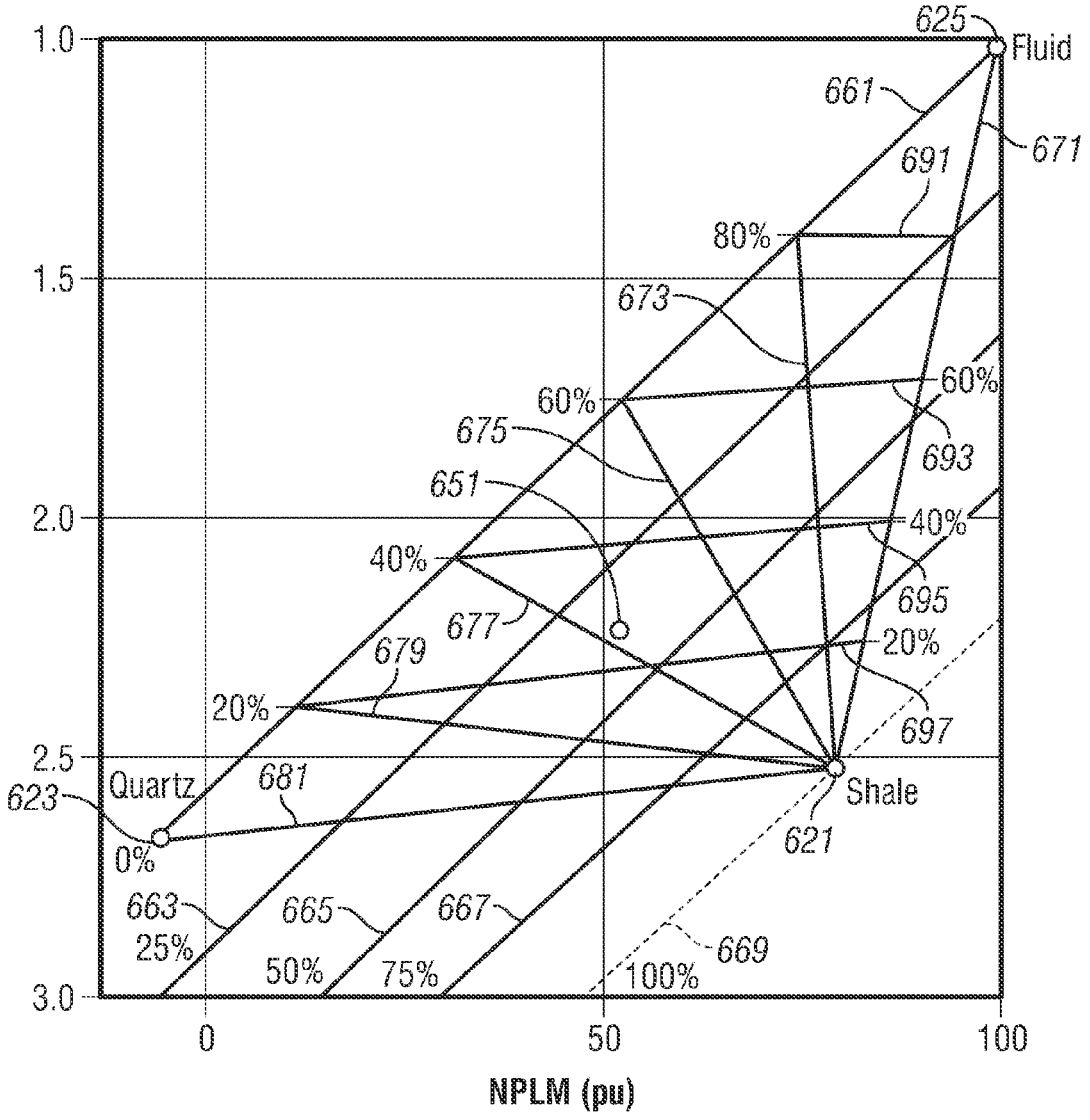
FIG. 6C shows an exemplary plot for characterizing a measured sample.

FIG. 6B shows a cross-plot similar to FIG. 6A with gamma ray values superimposed. Point 621 may be selected as characterizing a "pure shale" in the formation. Such a point is then used in a plot such as that shown in FIG. 6C to characterize a measured sample such as sample 651. In FIG. 6C, point 621 denotes a pure shale, point 623 denotes quartz or pure silica while the point 625 denotes 100% fluid. The lines 661, 663, 665, 667 and 669 correspond to 0%, 25%, 50%, 75% and 100% shale composition, respectively. The lines 671, 673, 675, 677, 679 and 681 correspond to total porosity percentages of 0%, 20%, 40%, 60%, 80% and 100% respectively. The lines 691, 693, 695 and 697 correspond to effective porosity percentages of 80%, 60%, 40% and 20% respectively. Thus, the point 651 is estimated to be a mixture of 70% sand, 30% shale, using the methods discussed herein. Additionally, point 651 has a total porosity of 41% and an effective porosity of 27%. The distributions referred to above may be based on bins identified in this section.

Figure 7:
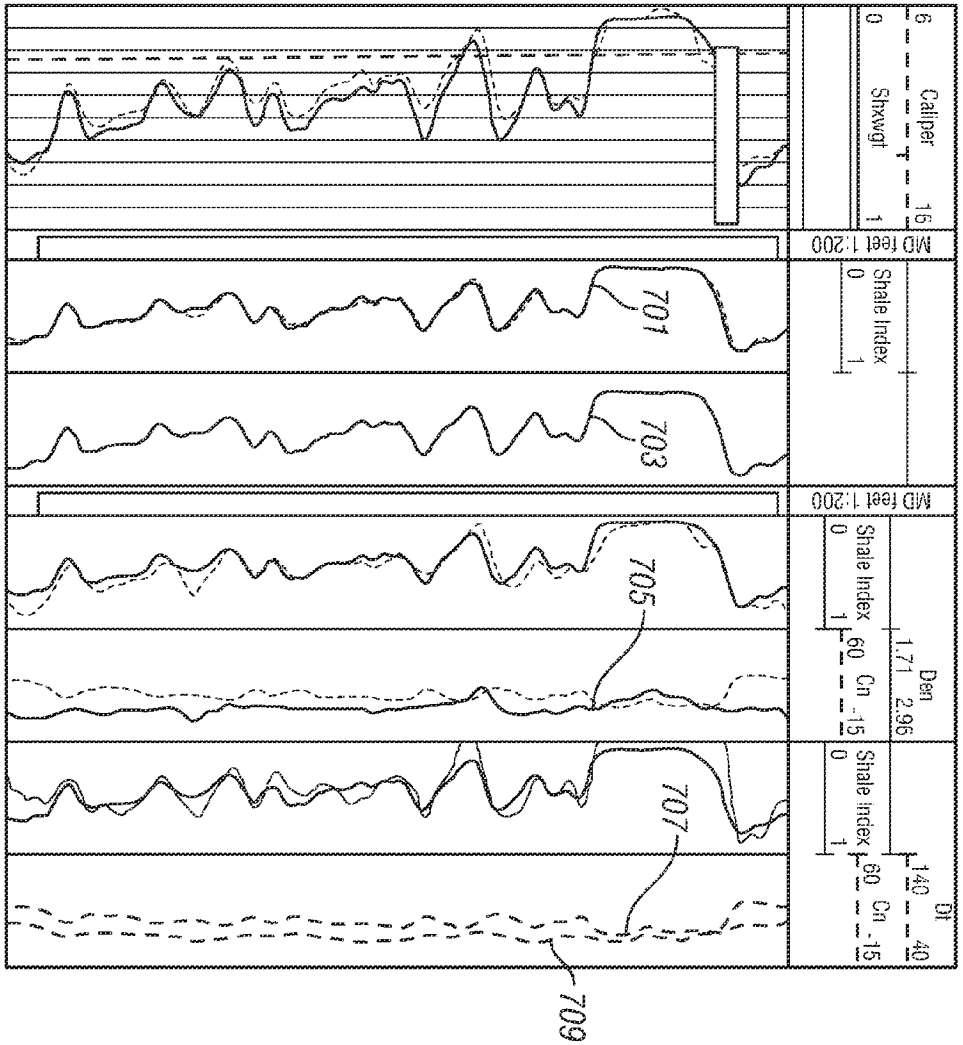
FIG. 7 illustrates a process using a cross-plot of gamma ray measurement to obtain a bulk shale estimate.

Given the bulk shale response and the data available, a deterministic approach may be employed to obtain a first estimate of the bulk volume of shale in the formation. In this case estimates were made from the gamma ray, density-neutron crossplots and acoustic-neutron crossplots, which were then combined in a user weighted process with more importance being placed on the Gamma Ray for the resulting bulk shale estimate (FIG. 7). Shown therein are the shale index 701, the gamma ray 703, the density 705, the neutron porosity 707, and the compressional wave slowness 709.

Once bulk shale volume is estimated at a selected level, the BHA may then be moved to a new level. At the new level, buffer B is reinitialized to null values, and seed data is introduced into buffer C. Calculations may continue through the entire acquisition cycle to yield a continuously updated estimate for the bulk shale volume. An alternate estimate of bulk shale volume may also be calculated using the original seed values to obtain a control estimate usable for monitoring the process.

In one aspect, the present disclosure provides a method of estimating a bulk shale volume of a formation. Measurements are obtained at a plurality of depths in a wellbore penetrating the earth formation and a first distribution is produced of the obtained measurements, A measurement is obtained at a selected depth in the wellbore and a second distribution is produced using the measurement at the selected depth and the measurements obtained at the plurality of depths. A cumulative distribution is produced cumulative of the first distribution and the second distribution. The bulk shale volume is estimated at the selected depth by comparing the cumulative distribution and the second distribution. A clean shale response is estimated using values from a range of maximum values of the second distribution and the cumulative distribution. A clean sand response is estimated using values from a range of minimum values of the second distribution and the cumulative distribution. The bulk shale volume may be estimated using a linear scale derived from the clean shale response and the clean sand response. The clean shale response is the maximum of: (a) a maximum value of the second distribution, and (b) an average of (i) a maximum value of the cumulative distribution, and (ii) an average value of a maximum range of values of the cumulative distribution. The clean sand response is the minimum of: (a) a minimum value of the second distribution, and (b) an average of (i) a minimum value of the cumulative distribution, and (ii) an average value of a minimum range of values of the cumulative distribution. The cumulative distribution is seeded at each selected level using one of: (i) prior up-hole drilling data, and (ii) data from an offset well. The second distribution is initialized to null values at each selected level. In one aspect, the bulk shale volume is estimated downhole. An acquisition level may be defined using one of: i) a depth interval, and ii) a time interval.

Although methods herein are described with respect to measurements of the natural gamma ray radiation of a formation, the method may be applied with minor modification to other measurements from other sensor and sensor arrays related to formation parameters.

While the foregoing disclosure is directed to the specific embodiments of the disclosure, various modifications will be apparent to those skilled in the art. It is intended that all such variations within the scope and spirit of the appended claims be embraced by the foregoing disclosure.

What is claimed is:

1. A method of drilling an earth formation, comprising:

conveying a sensor on a drill string in a wellbore penetrating the earth formation;

using the sensor to measure a formation parameter from the earth formation at a plurality of depths in the wellbore, wherein the formation parameter is indicative of bulk shale volume;

using a downhole processor to:

produce a plurality of distributions of the formation parameter, wherein a selected distribution of the plurality of distributions corresponds to a selected depth and includes the formation parameter measurements obtained at the selected depth;

produce a cumulative distribution of the formation parameter from the plurality of distributions;

estimate a clean shale response using maximum values from both of a distribution for a selected depth and the cumulative distribution;

estimate a clean sand response using minimum values from both of the distribution for the selected depth and the cumulative distribution;

create a scale related to bulk shale volume from the clean shale response and the clean sand response;

compare a value of the formation parameter sampled from the selected depth of the formation to the created scale to estimate the bulk shale volume of the formation at the selected depth; and alter a drill string direction to drill the wellbore in the formation along a selected profile indicated by the bulk shale volume.

2. The method of claim 1, wherein the scale is a linear scale.

3. The method of claim 1, wherein the clean shale response is the maximum of:

(a) a maximum value of the one of the plurality of distributions, and (b) an average of (i) a maximum value of the cumulative distribution, and (ii) an average value from a range of high values of the cumulative distribution.

4. The method of claim 1, wherein the clean sand response is the minimum of:

(a) a minimum value of the one of the plurality of distributions, and (b) an average of (i) a minimum value of the cumulative distribution, and (ii) an average value from a range of low values of the cumulative distribution.

5. The method of claim 1 further comprising seeding the cumulative distribution at the selected depth.

6. The method of claim 5, wherein the cumulative distribution is seeded using one of: (i) prior up-hole drilling data, and (ii) data from an offset well.

7. The method of claim 1 further comprising initializing a distribution buffer to null values prior to obtaining a distribution at a wellbore depth.

8. The method of claim 1 further comprising estimating the bulk shale volume using a downhole processor.

9. The method of claim 1, wherein the selected depth is selected according to one of: i) a depth interval, and ii) a time interval.

10. The method of claim 1, wherein the downhole processor processing the bulk shale volume according to a model to control an aspect of the drilling.

11. The method of claim 1 further comprising controlling a force application device of the drill string to alter the drilling direction of the drill string.

12. An apparatus for drilling an earth formation, comprising:

a drill string for drilling a wellbore penetrating the earth formation;

a sensor configured to obtain measurements of a formation parameter from the earth formation at a plurality of depths, wherein the formation parameter is indicative of bulk shale volume; and a downhole processor configured to:

produce a plurality of distributions of the formation parameter wherein a selected distribution of the plurality of distributions corresponds to a selected depth and includes the formation parameter measurements obtained at the selected depth;

produce a cumulative distribution cumulative from the plurality of distributions, estimate a clean shale response using maximum values from both of a distribution for a selected depth and the cumulative distribution;

estimate a clean sand response using minimum values from both of the distribution for the selected depth and the cumulative distribution;

create a scale related to bulk shale volume from the clean shale response and the clean sand response, estimate the bulk shale volume at the selected depth by comparing a value of the formation parameter sampled from the formation at the selected depth to the created scale, and alter a drill string direction to drill the wellbore in the formation along a selected profile indicated by the bulk shale volume.

13. The apparatus of claim 12, wherein the scale is a linear scale.

14. The apparatus of claim 12, wherein the clean shale response is the maximum of:

(a) a maximum value of the one of the plurality of distributions, and (b) an average of (i) a maximum value of the cumulative distribution, and (ii) an average value from a range of high values of the cumulative distribution.

15. The apparatus of claim 12, wherein the clean sand response is the minimum of:

(a) a minimum value of the one of the plurality of distributions, and (b) an average of (i) a minimum value of the cumulative distribution, and (ii) an average value from a range of low values of the cumulative distribution.

16. The apparatus of claim 12, wherein the processor is configured to seed the cumulative distribution at each selected depth.

17. The apparatus of claim 16, wherein the processor is configured to seed the cumulative distribution using one of: (i) prior up-hole drilling data, and (ii) data from an offset well.

18. The apparatus of claim 12, wherein the processor is configured to initialize a distribution buffer to null values prior to obtaining a distribution at a wellbore depth.

19. The apparatus of claim 12, wherein the processor is configured to estimate the bulk shale volume at a downhole location.

20. The apparatus of claim 12, wherein the selected depth is selected using one of: i) a depth interval, and ii) a time interval.

21. A non-transitory computer-readable medium having instructions stored thereon for causing a computer processor to execute a method for drilling an earth formation, the method comprising:

obtaining measurements of a formation parameter indicative of bulk shale volume at a plurality of depths in a wellbore penetrating the earth formation using a sensor conveyed on a drill string;

producing a plurality of distributions of the formation parameter wherein a selected distribution of the plurality of distributions corresponds to a selected depth and includes the formation parameter measurements obtained at the selected depth;

producing a cumulative distribution cumulative of from the plurality of distributions;

estimating a clean shale response using maximum values from both of a distribution for a selected depth and the cumulative distribution estimating a clean sand response using minimum values from both of the distribution for the selected depth and the cumulative distribution;

creating a scale related to bulk shale volume from the clean shale response and the clean sand response;

comparing a value of the formation parameter sampled from the formation at the selected depth to the created scale to estimate the bulk shale volume of the formation at the selected depth; and altering a drill string direction to drill the wellbore in the formation along a selected profile indicated by the bulk shale volume.

22. The non-transitory computer-readable medium of claim 21 further comprising at least one of: (i) a ROM, (ii) an EPROM, (iii) an EAROM, (iv) a flash memory, and (v) and optical disk.

* * * * *